United States Patent [19]

England et al.

[11] Patent Number: 4,509,498

[45] Date of Patent: Apr. 9, 1985

[54] DAMPER CONTROL

[76] Inventors: W. Dean England, 2615 - 109th Pl. NE., Belleuve, Wash. 98004; Gerald J. Enneking, 4243 SW. 328th, Federal Way, Wash. 98003

[21] Appl. No.: 349,855

[22] Filed: Feb. 18, 1982

[51] Int. Cl.[3] ..... F23L 13/02

[52] U.S. Cl. ..... 126/288; 126/286

[58] Field of Search ..... 126/285 R, 285 A, 288, 126/286, 289, 120, 295; 98/58-60

[56] References Cited

U.S. PATENT DOCUMENTS

| | | | |
|---|---|---|---|
| 1,203,036 | 10/1916 | Nauffts | 126/288 |
| 1,669,825 | 5/1928 | Guy | 126/288 |
| 1,862,456 | 6/1932 | Barrows | 126/288 |
| 3,773,029 | 11/1973 | Kent | 126/288 |
| 3,831,582 | 8/1974 | Mahoney | 126/286 |
| 3,880,142 | 3/1975 | Fowles | 126/288 |
| 4,007,730 | 2/1977 | Heebink | 126/286 |
| 4,015,587 | 4/1977 | Wincek | 126/286 |
| 4,265,217 | 5/1981 | Flaherty et al. | 126/288 |
| 4,305,377 | 12/1981 | Shull | 126/288 |

FOREIGN PATENT DOCUMENTS

| | | | |
|---|---|---|---|
| 2027 | of 1861 | United Kingdom | 126/288 |
| 7586 | of 1907 | United Kingdom | 126/288 |

*Primary Examiner*—James C. Yeung

*Attorney, Agent, or Firm*—Seed and Berry

[57] ABSTRACT

A damper control is provided which extends the control arm to the lintel. It is a support bracket comprised of a first angle which is secured to the lintel and a second angle which is secured to the first by a set collar and screw. A right angle bell crank is pivotally connected to the support bracket. One end of the bell crank is connected by a horizontal connecting rod, adjustable connecting link and upright connecting rod to the damper control arm. A stop projects downward into the path of the control lever to limit its rotational movement.

5 Claims, 7 Drawing Figures

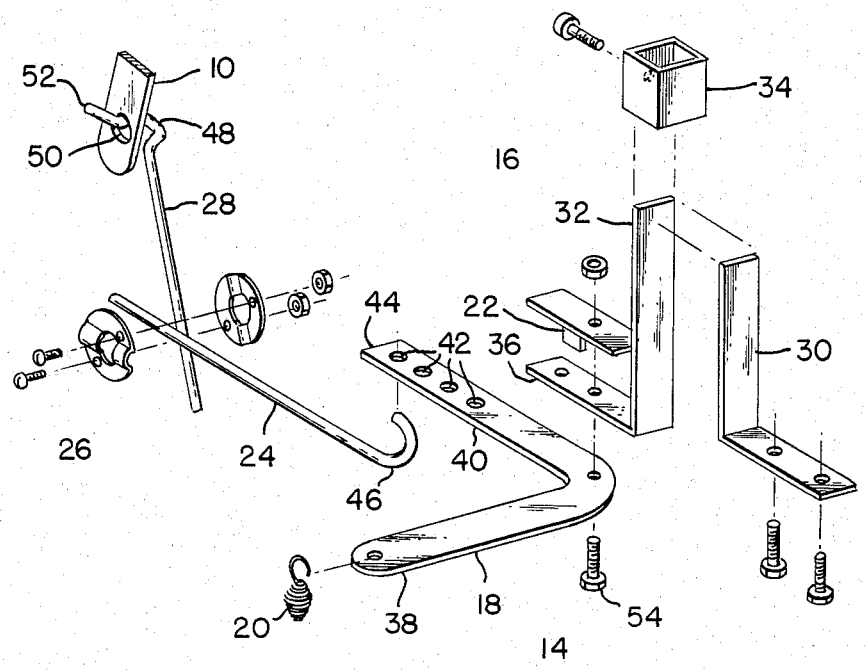
FIG. 5
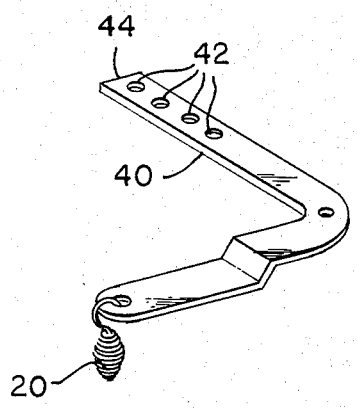
FIG. 6
FIG. 7
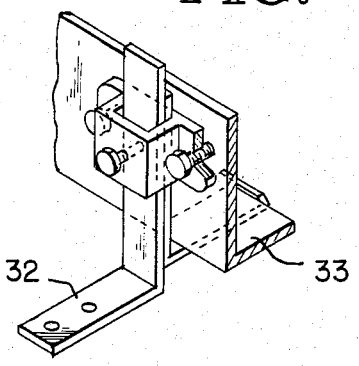

DAMPER CONTROL

SUMMARY OF THE INVENTION

A damper control is provided which extends an existing fireplace damper control lever to a position more readily accessable to the user. It consists, in part, of an adjustable height support bracket which is fastened to the fireplace lintel. The support bracket is formed from a pair of metal angles which are connected together by a clamp. A right angle bell crank control arm is pivotally suspended from the apex formed by the two arms to the support bracket for movement in a horizontal plane. A control handle is attached to the outer end of one arm and a series of holes are provided the end of the other arm. A projecting stop is attached to the support bracket and extends downward into the path of the control arm to limit its movement to approximately 180 degrees of rotation. A horizontal rod having an upturned hook is connected through one of the holes on the end of the bell crank. A upright positioned rod has a hook which engages the end of the existing fireplace damper control rod. The other end of the upright connecting rod is adjustably clamped to the horizontal connecting rod.

BRIEF DESCRIPTION OF THE DRAWINGS

FIG. 5 is an exploded view of the damper control.

FIG. 6 is a perspective view of the control lever with an offset in the operating arm.

FIG. 7 is a perspective view, with parts broken away for illustration purposes, of an alternative form of the adjustable support bracket.

DETAILED DESCRIPTION OF THE INVENTION

Figure 1:
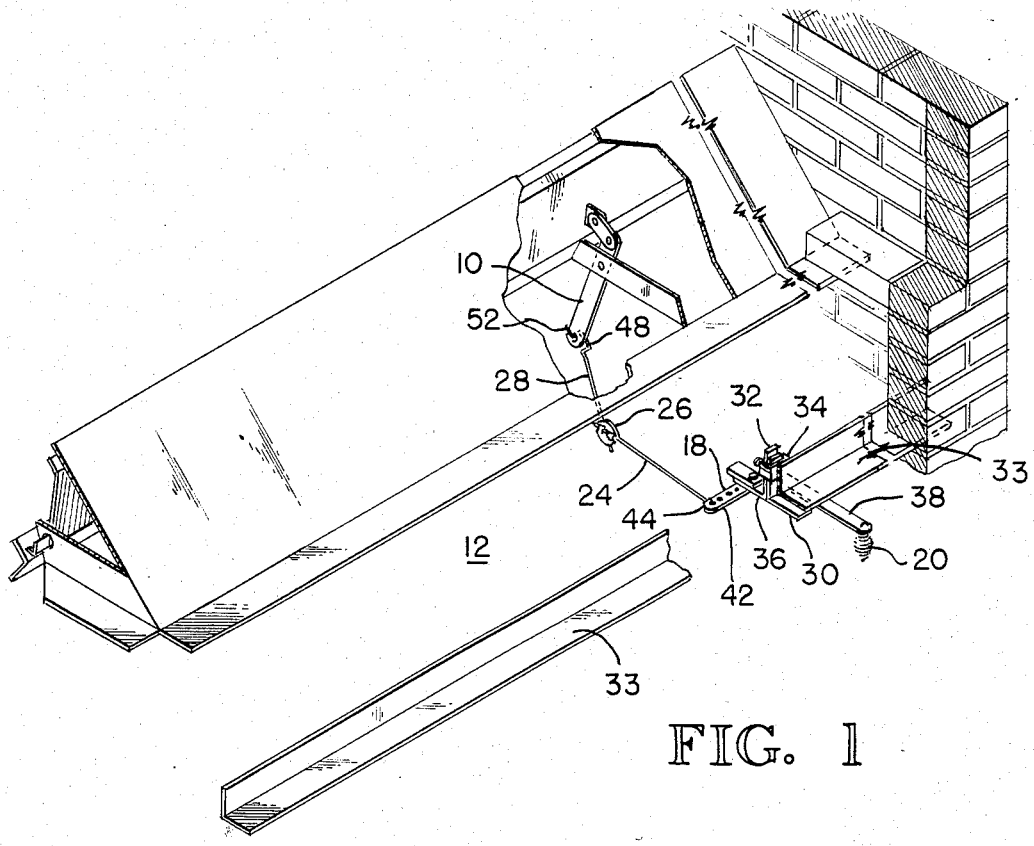
FIG. 1 is a perspective view of the mounted damper control with the lever at the midpoint of its travel.
Figure 2:
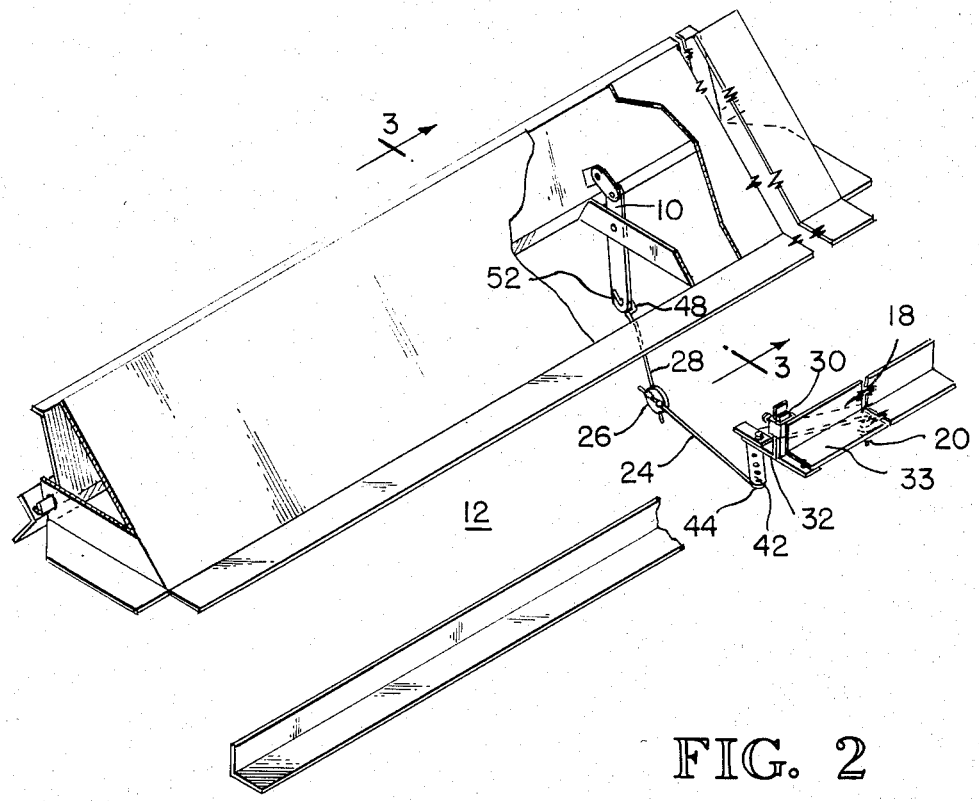
FIG. 2 is a perspective view similar to FIG. 1 with the control lever in the near full open position.
Figure 3:
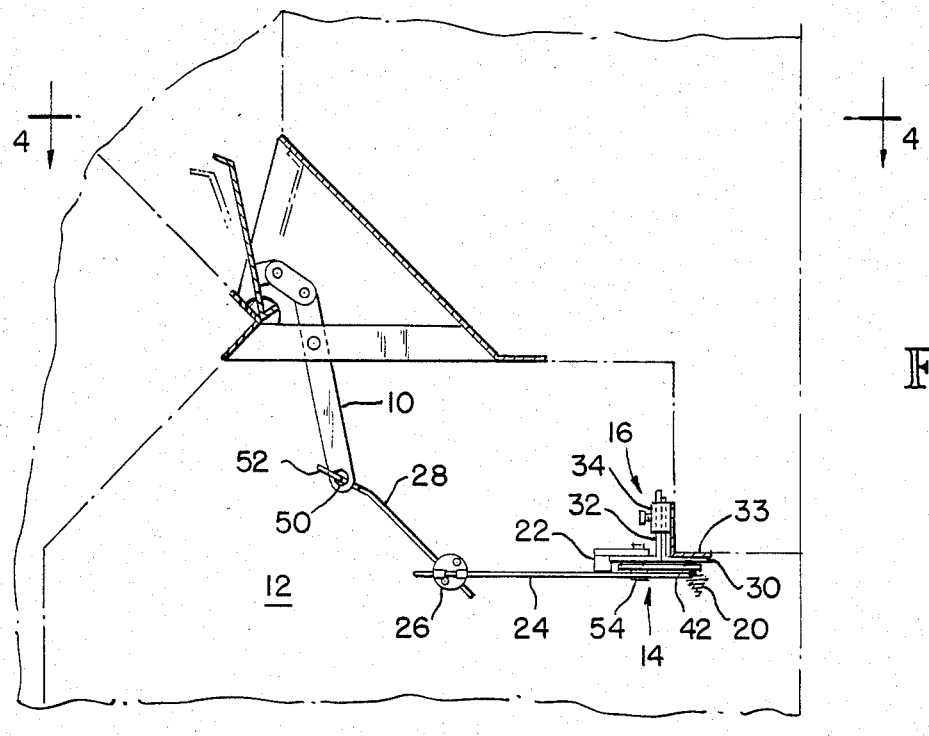
FIG. 3 is a section view along the line 3—3 from FIG. 2.

The invention relates to a damper control for fireplaces of the type having a damper control arm 10 which projects downward into the fireplace opening 12. Normally to operate this type of damper it is necessary to reach into the upper interior of the fireplace to move the control arm forward to open the damper or rearwardly to close the damper. Because the interior of the fireplace is normally covered with black soot the operator often gets his or her hands or clothing soiled. Also it is often very difficult to confirm whether the damper is open or closed by viewing the damper control arm or by visually inspecting the damper. The invention extends the damper control to a position readily accessible to the operator and also gives a visual indication of the damper position. The damper control also provides a mechanical means for preventing the damper from being blown open by a gust of wind. The damper control 14 consists of an adjustable support bracket 16, and control lever 18, handle 20, a stop 22, a horizontal connecting rod, an adjustable connector 26 and an upright connecting rod 28.

The preferred embodiment of the invention is illlustrated in the drawings and described below.

The adjustable support bracket consists of a pair of metal angles 30 and 32. Angle 30 is secured, such as by bolting, to the lintel 33 in alignment with the damper control arm 10. The amount by which the horizontal leg 36 of the angle 32 projects below the lintel is adjustable through the use of an adjustable connection such as, the collar and set screw 34 illustrated.

An alternative form of the adjustable support bracket is illustrated in FIG. 7. In this version the collar is provided with oppositely projecting flanges or wings through which threaded screws or bolts project. The horizontal leg of the angle has an upturned end which hooks over the edge of the lintel 33. This form of the bracket is preferred over the version discussed above.

The control lever 18 consists of a bell crank which is pivotally secured near its apex to the horizontal leg 36 of angle 32. A convenient means of grasping the lever is provided, such as, by the spring handle 20 which is attached to the end of arm 38 of the control lever. Preferably the end of arm 38 is offset downward as shown in FIG. 6. The other arm 40 has a series of holes 42 spaced sequentially inward from the end 44.

The linkage between the control lever 18 and the damper control arm 10 consists of the horizontal connecting rod 24 adjustable connector 26 and upright connecting rod 28. The horizontal connecting rod consists of a straight rod having a hook 46 in one end which extends upwardly and hooks into one of the holes 42 in the end of the control lever. The upright control rod has an offset loop 48 near its end which engages the hole 50 typically found in the end of the control arm 10. The projection 52 on the end of the rod prevents it from inadvertently disengaging from the control arm 10. The adjustable connector 26 preferably consists of a pair of circular plates held together by screws which clamp the connection rods together. Each plate has a groove on its interior surface for receiving the surface of the rod which it contacts. This maintains the rods at a fixed angle with respect to one another but allows the individual adjustment of the lengths of the rods when the screws holding the plates together are loosened.

Figure 4:
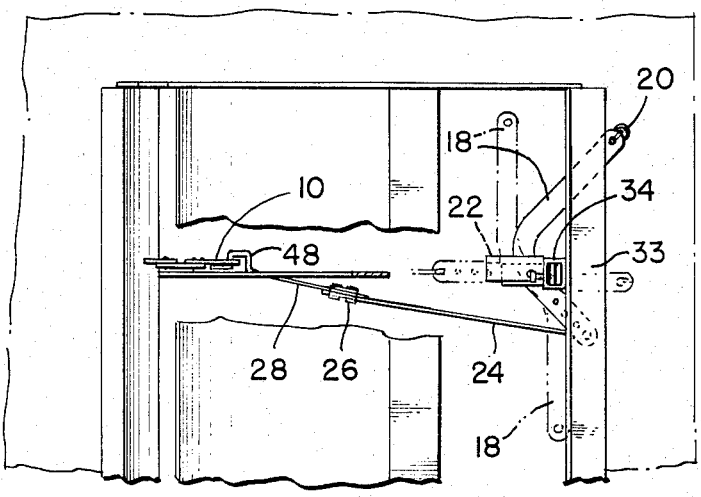
FIG. 4 is a top section view taken along the line 4—4 from FIG. 3.

The stop 22 is secured to the adjustable support bracket 16 and projects downward into the path of the control lever 18 to limit its movement. The movement is limited between two positions approximately 180 degrees apart and so that arm 38 is roughly parallel to the face of the fireplace at either extreme of its travel. See FIG. 4 and the positions shown in phantom. In its preferred form stop 22 constists of a metal angle secured by the connector 54 with one flange abutting and parallel to the top surface of the horizontal leg 36 of angle 32. All of the downward projecting flange of the angle which extends below the bottom surface of the horizontal leg 36 is removed except for an endpiece which forms the stop tab.

In order to use the damper control the height of the control lever is adjusted using the collar and set screw so that the arm is $\frac{1}{4}$ inch or more below the level of the fireplace doors, lintel, or screen. The appropriate hole 42 in which the hook 40 of the horizontal connecting rod is connected is determined by trial and is dependent on the distance of travel of existing fireplace damper arm. The connector 26 is loosened to allow the vertical and horizontal adjustment of the connecting rods. They are adjusted so that the horizontal arm is roughly level and the upright arm is in a substantially vertical position when viewed from the front of the fireplace. The control lever is then rotated from stop to stop in order to open and close the damper.

The construction of the damper control is such that the control lever does not extend from the fireplace opening except when being operated. It also does not project down to any significant extent into the fireplace opening and is easily accessed from the front of the fireplace. The construction fits a wide variety of fireplace damper installations.

We claim:

1. A front operated damper control for a fireplace having a damper with a downward projecting operating arm and a lintel extending across the top of its frontal opening, comprising:

(a) an adjustable height support bracket securable to the lintel;

(b) a control lever including, at least, a right angle bell crank lever pivotally secured near the intersection of its two arms to the support bracket for rotation in a horizontal plane with the body of one arm defining a plurality of holes extending inwardly in sequence from its outer end;

(c) a horizontal connecting rod having a hook in its end which engages the rod by extending through one of the holes in the control lever arm from below;

(d) an upright connecting rod having an offset loop in its end for engaging the damper operating lever; and (e) means for adjustably connecting the horizontal connecting rod to the upright connecting rod.

2. A front operated control for a fireplace damper, as claimed in claim 1, comprising, in addition, a stop projection extending downward from the support bracket to engage the control lever and limit its travel.

3. A front operated control for a fireplace damper of the type having a downward projecting operating arm, comprising:

(a) a support bracket securable to the lintel wherein the support bracket includes a first right angle bracket connectable to the lintel with one leg projecting downward, a second right angle bracket having one leg positionable horizontally and the other leg alignable with the downward projecting leg of the first bracket and means for adjustably securing the adjacent legs together to permit adjustment of the height of the control lever;

(b) a control lever pivotally secured at a central location to the support bracket for rotation in a horizontal plane;

(c) a horizontal connecting link pivotally connected to one end of the control lever; and (d) an upright connecting link connected to the horizontal connecting link and pivotally connectable to the damper control arm.

4. A front operated control for a fireplace damper, as claimed in claim 3, wherein the control lever comprises a bell crank pivotally connected to the support bracket proximate the apex formed by the lever arms of said crank.

5. A front operated control for a fireplace damper, according to claims 3 or 4, wherein said support bracket includes a stop projection to limit the rotational movement of the lever arm.

* * * * *